US006412712B1

(12) United States Patent
Buckley

(10) Patent No.: US 6,412,712 B1
(45) **Date of Patent: *Jul. 2, 2002**

(54) FUEL INJECTOR

(75) Inventor: Paul Buckley, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/505,253

(22) Filed: Feb. 15, 2000

(30) Foreign Application Priority Data

Feb. 16, 1999 (GB) ..... 9903496

(51) Int. Cl.[7] ..... F02M 61/00

(52) U.S. Cl. ..... 239/533.12; 239/533.2; 239/584

(58) Field of Search ..... 239/533.2, 533.3, 239/533.4, 533.5, 533.6, 533.9, 533.11, 533.12, 538, 584

(56) References Cited

U.S. PATENT DOCUMENTS

| | | | | |
|---|---|---|---|---|
| 1,155,266 A | * | 9/1915 | Pasel | |
| 4,526,323 A | * | 7/1985 | Seifert | 239/533.4 |
| 5,029,759 A | * | 7/1991 | Weber | 239/533.12 |
| 5,092,039 A | * | 3/1992 | Gaskell | 239/533.12 |
| 5,458,292 A | * | 10/1995 | Hapeman | 239/533.4 |
| 5,947,389 A | * | 9/1999 | Hasegawa et al. | 239/533.2 |
| 5,975,433 A | * | 11/1999 | Hasegawa et al. | 239/533.12 |
| 5,979,802 A | * | 11/1999 | Hasegawa | 239/533.12 |
| 6,189,817 B1 | * | 2/2001 | Lambert | 239/533.2 |

* cited by examiner

*Primary Examiner*—Lesley D. Morris
*Assistant Examiner*—Christopher Kim
(74) *Attorney, Agent, or Firm*—Wells St. John P.S.

(57) ABSTRACT

A fuel injector comprising a valve needle engageable with a seating to control the supply of fuel to an outlet opening, comprising an adjustment member including an opening. The adjustment member is moveable to move the opening thereof relative to the outlet opening to vary the restriction to fuel flow formed by said outlet opening and, hence, the rate at which fuel is delivered by said injector.

11 Claims, 7 Drawing Sheets

FUEL INJECTOR

This invention relates to a fuel injector, and in particular to a fuel injector suitable for use in delivering fuel under pressure to a cylinder of a compression ignition internal combustion engine.

A typical fuel injector includes a valve needle slidable within a bore and engageable with a seating to control the supply of fuel to a chamber downstream of the seating, the chamber communicating with a plurality of outlet openings. The outlet openings form a restriction to the flow of fuel and, for a given fuel pressure, serve to restrict the rate at which fuel is delivered by the injector. As the outlet openings are pre-drilled, no adjustment of the restriction to fuel flow can be made after manufacture, and the fuel flow rate cannot be adjusted in use.

In some known arrangements, for example those in which a secondary valve needle is slidable within a bore formed in the valve needle, the number of outlet openings used at any instant can be controlled. Controlling the fuel flow rate in this manner is disadvantageous, however, in that the overall spray formation or pattern changes as the number of openings in use changes, and those openings which are not in use may become blocked by coke or lacquer.

It is an object of the invention to provide an injector in which the restriction to fuel flow formed by the outlet openings of an injector, and hence the fuel flow rate, can be altered, in use, whilst using all of the outlet openings.

According to the present invention there is provided a fuel injector comprising a valve needle engageable with a seating to control the supply of fuel to an outlet opening, and an adjustment member including an opening, the adjustment member being moveable to move the opening thereof relative to the outlet opening to vary the rate at which fuel is delivered by the injector.

The adjustment member is conveniently provided with a first opening and a second opening, the adjustment member being moveable between a first position in which the first opening communicates with the outlet opening, the first opening and the outlet opening together defining a first restriction to fuel flow, and a second position in which the second opening communicates with the outlet opening, the second opening and the outlet opening together defining a second restriction to fuel flow.

The first and second openings may be of substantially equal diameter, the entry ends of the first and second openings being of different shapes to modify the restriction to fuel flow. For example, the entry end of the first opening may be sharp, the entry end of the second opening being radiused. As a result, a variation in flow rate of up to approximately 30% can be achieved.

The adjustment member may be angularly moveable or may be axially moveable between its first and second positions.

The seating may be defined by part of the adjustment member.

As the arrangements described hereinbefore permit the effective restriction to fuel flow to be adjusted, it will be appreciated that, for a given fuel pressure, the rate at which fuel is delivered by the injector can be adjusted.

In an alternative arrangement, the adjustment member may be moveable relative to the outlet opening to vary the separation of the opening of the adjustment member from the outlet opening whilst maintaining communication therebetween. Such an arrangement has the advantage that the effective restriction to flow, and hence the fuel flow rate, is continuously variable rather than being adjustable between two or more discrete levels.

The invention will further be described, by way of example, with reference to the accompanying drawings, in which.

Figure 1:
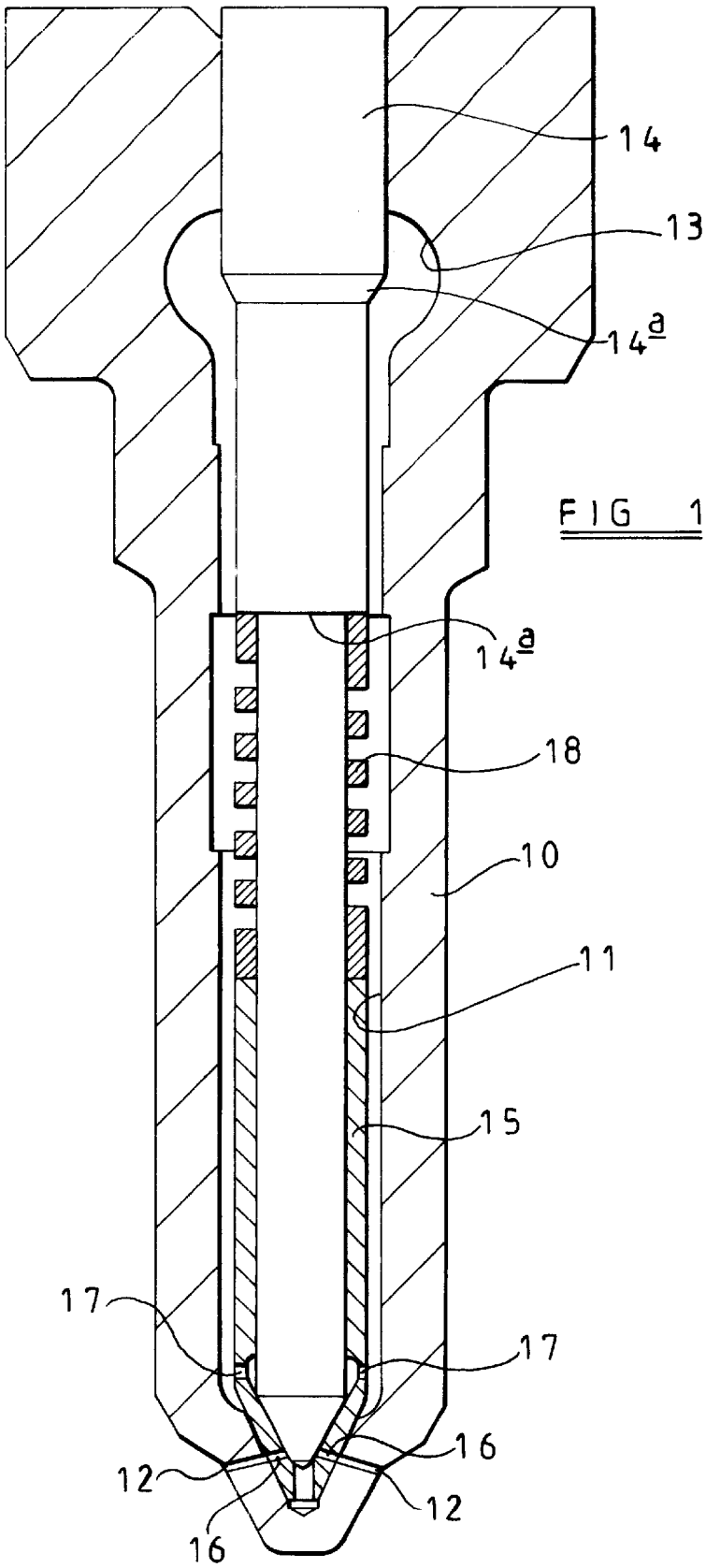
FIG. 1 is a sectional view of part of a fuel injector in accordance with an embodiment of the invention.
Figure 2:
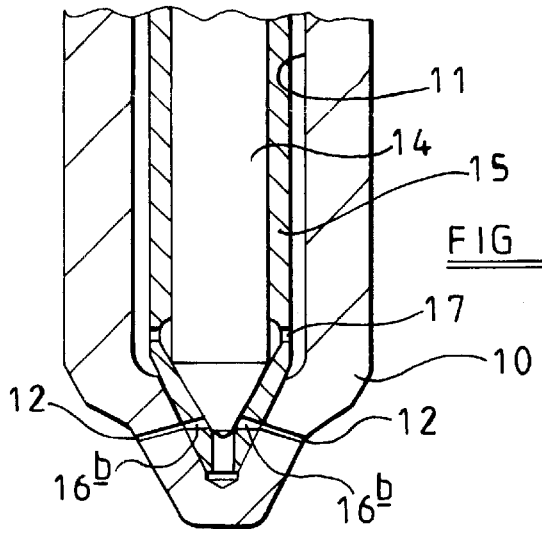
FIG. 2 is a sectional view of part of the injector of FIG. 1 in another mode of operation.
Figure 3A:
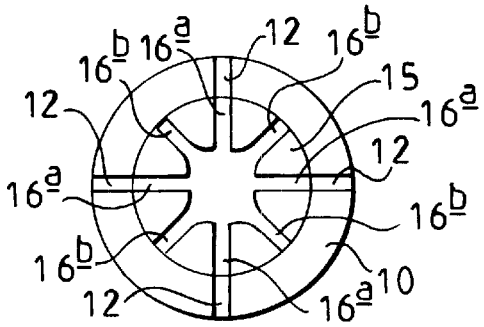
Figure 3B:
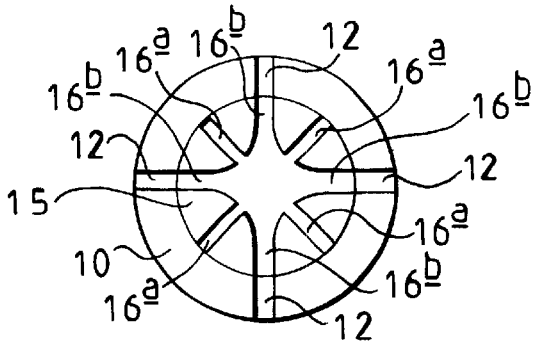
Figure 4A:
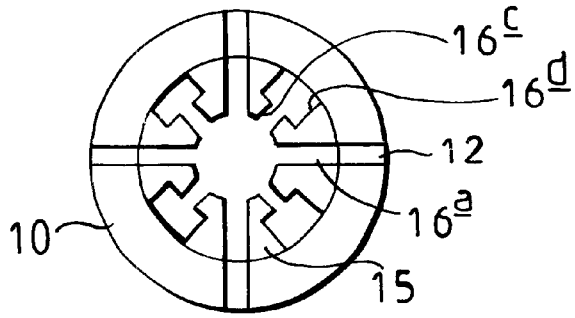
Figure 4B:
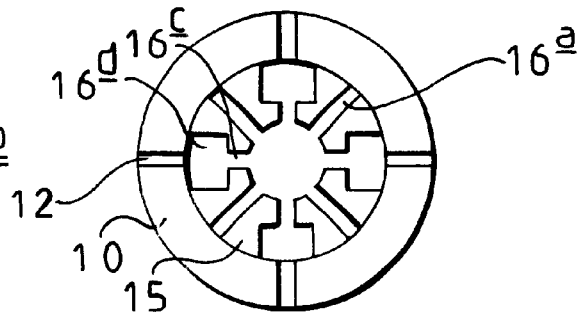
Figure 8A:
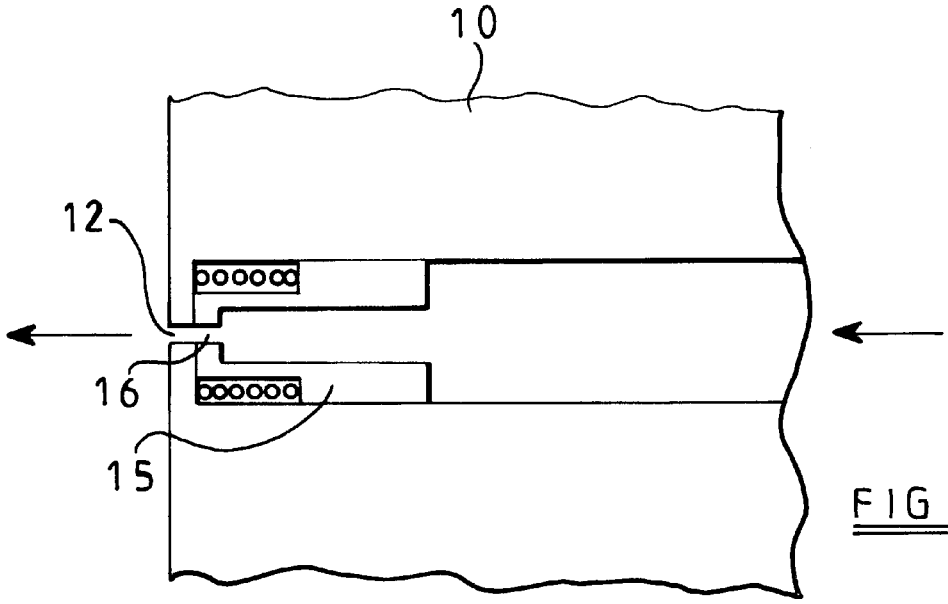
Figure 8B:
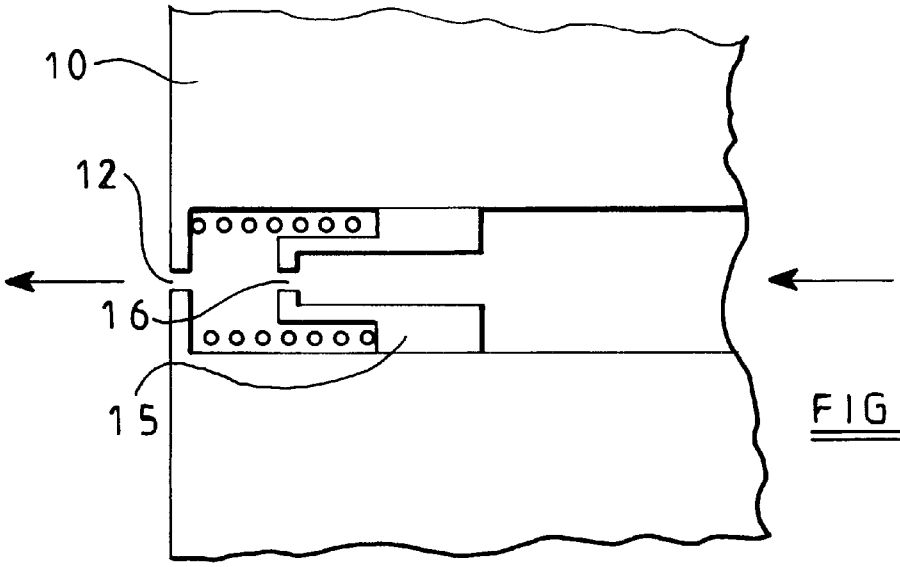
Figure 9:
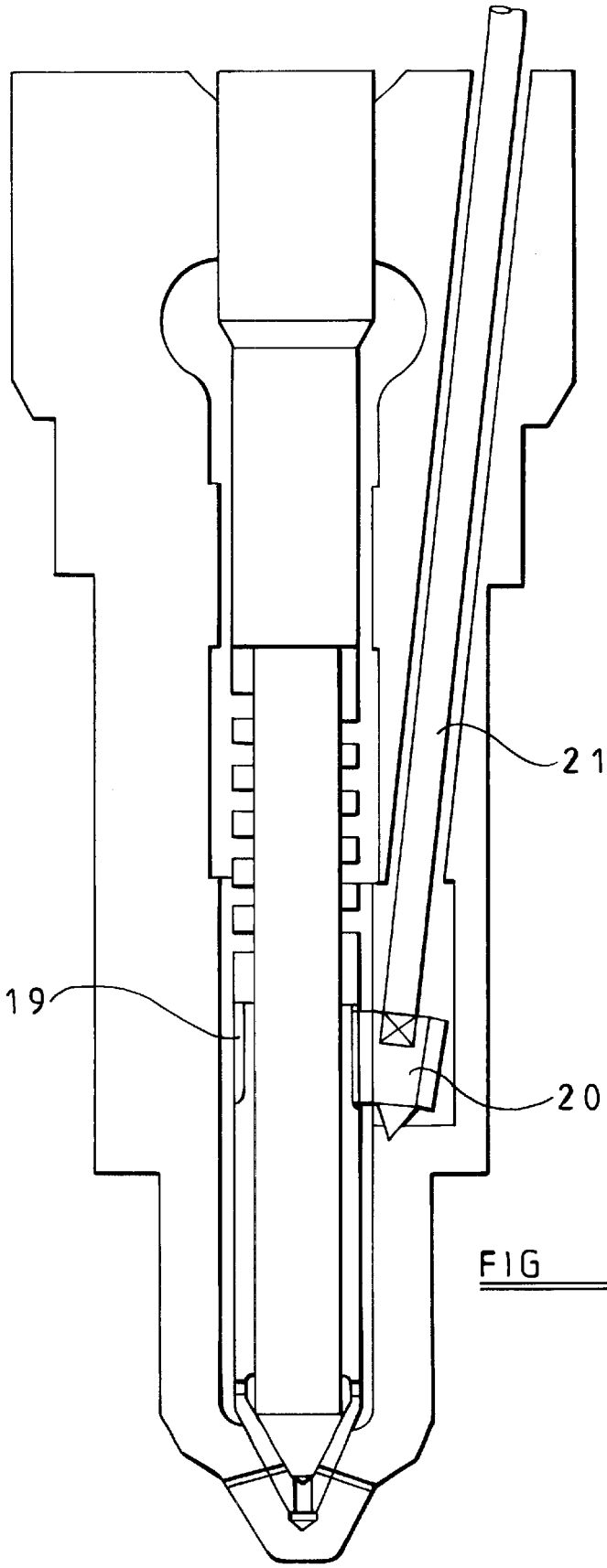

FIGS. 3*a* and 3*b* are diagrams illustrating the modes of operation of the embodiment of FIGS. 1 and 2;

FIGS. 4*a* and 4*b* are views similar to FIGS. 3*a* and 3*b* illustrating a modification;

FIGS. 5 to 8 are diagrammatic views illustrating further modifications; and FIG. 9 is a view similar to FIG. 1 illustrating a technique for switching the injector between its modes of operation.

The fuel injector illustrated, in part, in FIG. 1 comprises a nozzle body 10 provided with a blind bore 11 which defines, adjacent its blind end, a seating area. Downstream of the seating area, the nozzle body 10 is provided with a plurality of outlet openings 12 in the form of small diameter drillings. The bore 11 is shaped to define an annular gallery 13 which communicates with a drilling (not shown) forming part of a supply passage whereby the bore 11 is supplied with fuel under high pressure from an appropriate fuel source. The fuel source may take the form of a common rail charged with fuel to a suitably high pressure by a fuel pump. Alternatively, for example, the fuel source may take the form of a rotary distributor pump.

A valve needle 14 is slidable within the bore 11, the valve needle 14 including a region of diameter substantially equal to the diameter of the adjacent part of the bore 11 to guide the needle 14 for sliding movement, and forming a substantially fluid tight seal with the nozzle body 10. The needle 14 is of stepped form, including thrust surfaces 14*a* which are exposed to the fuel pressure within the bore 11 and orientated such that the application of high pressure fuel to the bore 11 applies a force to the needle 14 urging the needle 14 in a direction away from the blind end of the bore 11. The end part of the needle 14 adjacent the blind end of the bore 11 is slidable within an adjustment member 15 in the form of a sleeve. The adjustment member 15 is shaped for engagement with the seating area defined by the bore 11, the interior of the adjustment member 15 defining a seating with which an end region of the needle 14 is engageable. Downstream of the seating, the adjustment member 15 is provided with a plurality of openings 16 which are orientated such as to be registrable with the outlet openings 12 provided in the nozzle body 10. Upstream of the seating, the adjustment member 15 is provided with radially extending drillings 17 which permits communication between the bore 11 and the interior of the adjustment member 15.

A spring 18 is provided between the adjustment member 15 and a shoulder defined by the needle 14, the spring 18 acting to urge the adjustment member 15 into engagement with the seating area defined by the bore 11. The spring 18 may take the form of a coiled compression spring, but in the embodiment illustrated in FIG. 1, the spring 18 takes the form of a machined spring.

Where the annular gallery 13 is arranged to communicate with the common rail of a common rail fuel system, then the injector further comprises a control arrangement arranged to control movement of the needle 14, and thereby control the timing of commencement and termination of injection.

As illustrated most clearly in FIGS. 3*a* and 3*b* the openings 16 provided in the adjustment member 15 comprise a first set of openings 16*a* and a second set of openings 16*b*. The first set of openings 16*a* take the form of drillings of diameter substantially equal to the diameter of the outlet openings 12. The second set of openings 16*b* are similar to the openings 16*a* but are radiused at their innermost ends. The adjustment member 15 is angularly adjustable between the position illustrated in FIGS. 1 and 3*a* in which the first set of openings 16*a* are arranged to register with the outlet openings 12 and a second position illustrated in FIGS. 2 and 3*b* in which the second set of openings 16*b* communicate with the outlet openings 12. The provision of the radiused end regions on the openings 16*b* result in the combination of the openings 16 and outlet openings 12 forming a smaller restriction to the flow of fuel when the adjustment member 15 occupies the position illustrated in FIGS. 2 and 3*b* than that when the adjustment member 15 occupies the position illustrated in FIGS. 1 and 3*a*. The change in fuel flow rate which can be achieved in this manner is approximately 30%.

In use, prior to commencement of injection, a control arrangement is used to determine which rate of fuel delivery is desirable taking into account the engine operating conditions, and the adjustment member 15 is moved, angularly, to the appropriate position to bring either the first set of openings 16*a* or the second set of openings 16*b* into communication with the outlet openings 12. Once this position has been reached, the needle 14 is allowed to lift away from the seating defined by the adjustment member 15, such movement permitting fuel to flow from the bore 11 through the drillings 17 to the interior of the adjustment member 15 and through the appropriate set of openings 16 to the outlet openings 12 from where the fuel is delivered to the combustion space of the cylinder of an engine with which the injector is associated. When it is determined that injection should be terminated, the needle 14 is returned into engagement with the seating defined by the adjustment member 15, thereby breaking the communication between the interior of the bore 11 and the outlet openings 12. Throughout the injection, the spring 18 ensures that the adjustment member 15 is retained in engagement with the seating area defined by the bore 11 thus preventing direct communication between the bore 11 and the outlet openings 12.

Although as described hereinbefore, the adjustment member 15 is rotated to the desired position prior to commencement of injection, it will be appreciated that the adjustment member 15 could be moved shortly after commencement of movement of the needle 14. In such an arrangement, the load upon the adjustment member 15 at the instant at which its position is to be adjusted is reduced, and so adjustment may be achieved more easily. Further, adjustment of the position of the adjustment member 15 may be achieved during injection to adjust the rate of fuel delivery during an injection cycle.

It will be appreciated that a number of techniques are suitable for use in adjusting the position of the adjustment member 15. For example, the adjustment member 15 could be keyed to the needle 14 such that angular movement of the needle 14 is transmitted to the adjustment member 15. In such an arrangement, a suitable motor is conveniently used to adjust the angular position of the needle 14 to control the rate at which fuel is delivered, in use. As an alternative to keying the adjustment member 15 to the needle 14, the adjustment member 15 may be keyed to the spring 18 which, in turn, is keyed to the needle 14 such that angular movement of the needle 14 is transmitted through the spring 18 to the adjustment member 15. Although in the description hereinbefore the spring 18 and adjustment member 15 are separate integers, if desired, these components could be formed integrally with one another.

FIG. 9 illustrates an alternative technique for adjusting the position of the adjustment member 15. In the arrangement illustrated in FIG. 9, the adjustment member 15 is provided, on its exterior, with a series of teeth 19 which are arranged to cooperate with teeth provided on a gear 20 carried by a drive shaft or pin 21. The drive shaft or pin 21 extends along the drilling which communicates with the gallery 13, the drilling being extended to open into a part of the bore 11 adjacent the adjustment member 15. A suitable motor, for example a stepper or piezo motor, is used to rotate the drive shaft or pin 21 to drive the gear 20 and hence cause rotation or angular adjustment of the position of the adjustment member 15 at appropriate points in the operating cycle of the injector.

In the arrangement illustrated in FIGS. 1 and 2, as the adjustment member 15 is seated against a seating area defined by part of the bore 11, and as the needle 14 is slidable within the adjustment member 15, it will be appreciated that a part of the needle 14 close to the blind end of the bore 11 is guided for sliding movement, the guiding of the needle assisting in ensuring that the needle 14 remains concentric with the bore 11 and the seating provided on the adjustment member 15.

It will be appreciated that in the arrangement described hereinbefore, all of the outlet openings 12 are used during each injection, thus the spray formation and shape does not vary between injections and the risk of blockage of the outlet openings 12 is reduced. The choice of injection rate determines the spray width, momentum and penetration for a given fuel pressure.

FIGS. 4*a* and 4*b* illustrate a modification to the arrangement described with reference to FIGS. 1 to 3. In the modification illustrated in FIG. 4*a* and 4*b* the openings 16*b* are replaced with drillings which are of stepped form and arranged to include regions 16*c* restricting the rate at which fuel is able to flow, the regions 16*c* opening into relatively large diameter regions 16*d*. In use, with the adjustment member 15 in the angular orientation illustrated in FIG. 4*a*, the effective area of the combination of the openings 16*a* and the outlet openings 12 is substantially equal to the cross-sectional area of the outlet openings 12. If the adjustment member 15 is moved to the position illustrated in FIG. 4*b*, then the effective area of the combination of the restriction 16*c* and the outlet openings 12 which are spaced apart from one another by the relatively large diameter region 16*d* is approximately 0.707 times the cross-sectional area of the outlet openings 12. It will therefore be appreciated that the movement of the adjustment member 15 from the position illustrated in FIG. 4*a* to that illustrated in FIG. 4*b* results in the restriction to fuel flow increasing, and hence in the fuel flow rate falling.

Figure 5A:
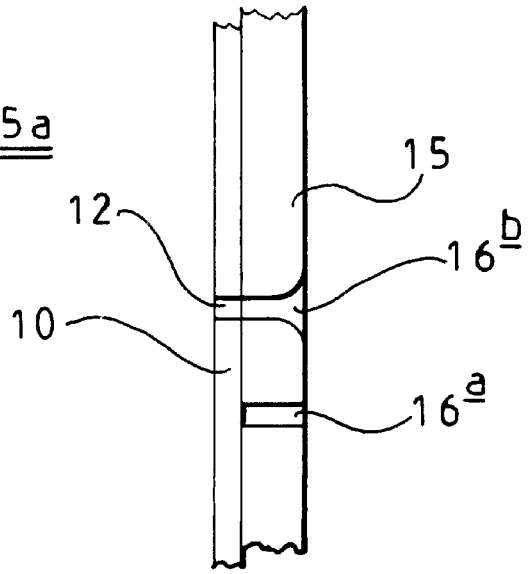
Figure 5B:
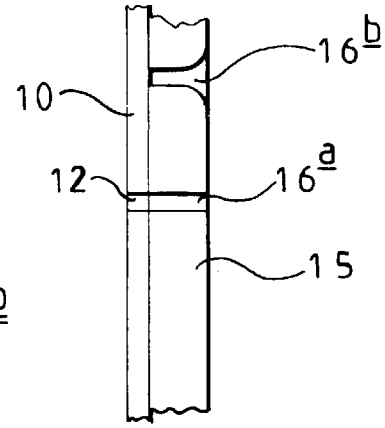

FIGS. 5*a* and 5*b* illustrate, diagrammatically, a modification to the arrangement described hereinbefore with reference to FIGS. 1 to 3, but in which the adjustment member 15 is axially movable relative to the bore rather than angularly adjustable, to adjust the fuel delivery rate. In the position illustrated in FIG. 5*a*, the opening 16*b* is in communication with the outlet opening 12, and so the restriction to fuel flow is relatively small and the fuel delivery rate is relatively high. FIG. 5*b* illustrates the injector with the adjustment member 15 lifted to a position in which the opening 16*b* no longer communicates with the outlet opening 12, and instead the opening 16*a* communicates with the outlet opening 12. As a result, the restriction to fuel flow is increased, and hence the rate at which fuel is delivered for a given fuel pressure is reduced.

Figure 6A:
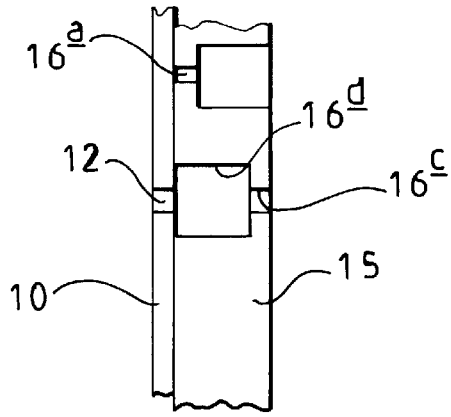
Figure 6B:
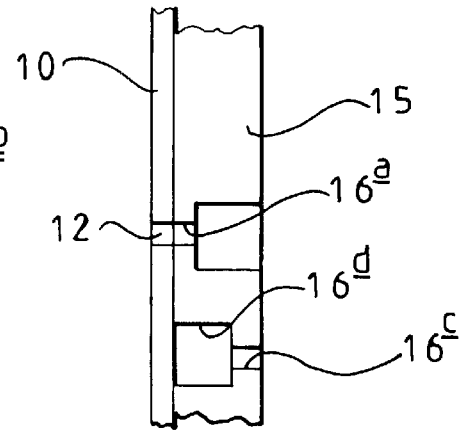

FIGS. 6*a* and 6*b* illustrate a modification to the arrangement described with reference to FIGS. 4*a* and 4*b* but in which the adjustment member 15 is axially moveable rather than angularly moveable between its first and second positions, as described with reference to FIGS. 5*a* and 5*b*.

Figure 7A:
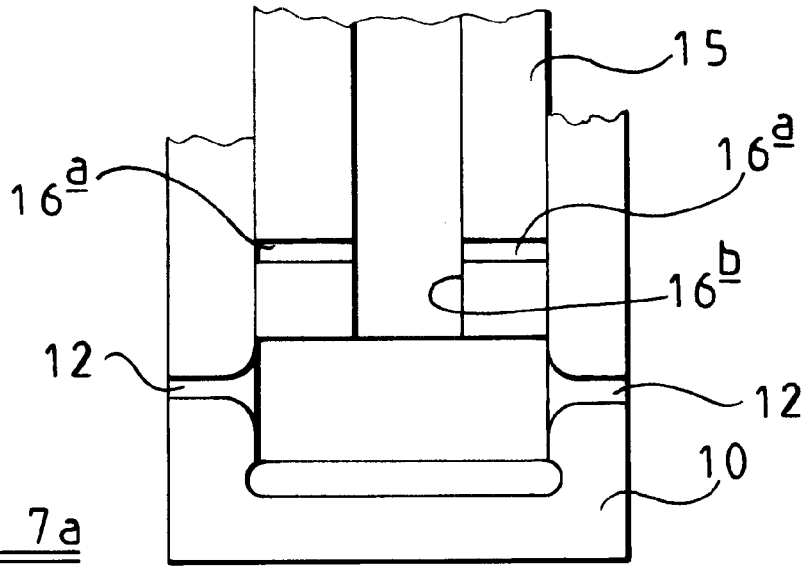
Figure 7B:
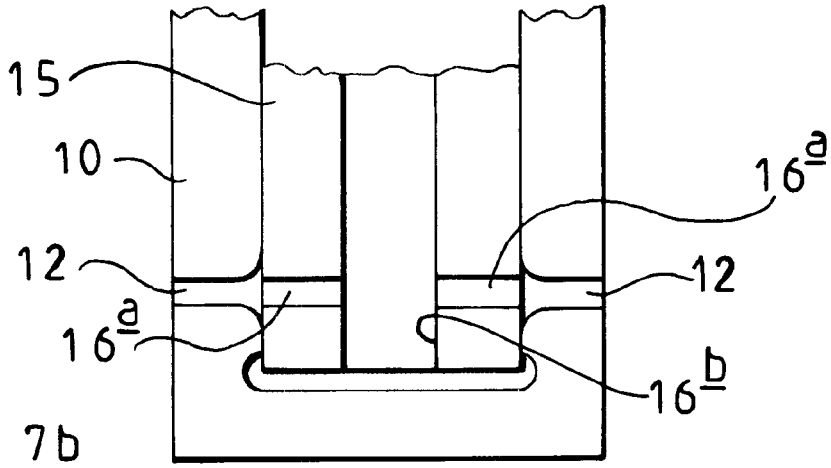

FIGS. 7*a* and 7*b* illustrate a further modification in which the adjustment member 15 is axially moveable between its first and second positions. In this arrangement, in the first position illustrated in FIG. 7*a* an opening 16*b* provided in the adjustment member 15 communicates with several outlet openings 12 provided in the injector. Movement of the adjustment member 15 from the position illustrated in FIG. 7*a* to that illustrated in FIG. 7*b* results in separate openings 16*a* moving into communication with corresponding ones of the outlet openings 12. It will be appreciated that the restriction to fuel flow in the arrangement of FIG. 7*a* is different to that of FIG. 7*b*, and hence for a given fuel pressure, the rate at which fuel is delivered can be adjusted by moving the adjustment member 15 between the position illustrated in FIG. 7*a* and that of FIG. 7*b*.

In each of the arrangements described hereinbefore, the adjustment member 15 is moveable between a first position in which fuel is permitted to flow at a first rate and a second position in which fuel is permitted to flow at a second rate. It will be appreciated that fuel flow, at a given fuel pressure, is permitted at only two discrete rates. Each of the embodiments may be modified to permit fuel delivery at a greater number of discrete rates, but the embodiments do not permit fuel delivery over a continuous range of fuel flow rates. FIGS. 8*a* and 8*b* illustrate a modification in which the rate at which fuel is permitted to flow can be continuously adjusted. In the arrangement of FIGS. 8*a* and 8*b* the adjustment member 15 is moveable between the position illustrated in FIG. 8*a* and a second position illustrated in FIG. 8*b*. The adjustment member 15 can be retained at any position between these two extreme positions. In the position illustrated in FIG. 8*a*, an opening 16 formed in the adjustment member 15 and of diameter equal to that of the outlet opening 12 communicates with and lies directly adjacent the outlet opening 12. In the position illustrated in FIG. 8*b*, the opening 16 of the adjustment member 15 is spaced from the outlet opening 12. With the adjustment member 15 in the position illustrated in FIG. 8*a*, the effective area of the restriction to fuel flow formed by the combination of the outlet opening 12 and the opening 16 is substantially equal to the cross-sectional area of the outlet opening 12, the outlet opening 12 and the opening 16 being of substantially equal cross-sectional area. When the adjustment member 15 is moved to the position illustrated in FIG. 8*b*, the effective area of the restriction constituted by the outlet opening 12 and the opening 16 is substantially equal to 0.707 times the cross-sectional area of the outlet opening 12. At intermediate positions, the effective area of the restriction will be between these two extremes. It will be appreciated that by appropriate adjustment of the position of the adjustment member 15, the restriction to fuel flow formed by the combination of the opening 16 and the outlet opening 12 can be controlled, and hence, for a given fuel pressure, the rate at which fuel is delivered can be controlled.

Although in the description hereinbefore, the manner in which the injector is controlled is described in relation to a common rail type injector, it will be appreciated that the needle 14 may simply be spring biased towards the blind end of the bore 11, the timing of commencement of injection being controlled by appropriate control of the time at which fuel under pressure is supplied to the bore 11, injection being terminated when the fuel pressure within the bore 11 falls to a level sufficiently low that the spring biasing of the needle 14 is able to return the needle 14 to the position illustrated in which the needle 14 engages the seating defined by the adjustment member 15.

I claim:

1. A fuel injector comprising a valve needle which is slidable within a blind bore provided in a body and which is engageable with a seating to control the supply of fuel to an injector outlet opening having an inlet end to which fuel is delivered and an outlet end from which fuel is delivered, an adjustable sleeve member which is arranged within the blind bore, the sleeve member including a first opening having a first outlet end which is directly co-operable with the inlet end of the injector outlet opening, a combination of the first opening and the injector outlet opening defining a restriction to fuel being delivered by said injector, said adjustable sleeve member being moveable to move said first opening thereof relative to said outlet opening to vary the restriction to fuel flow formed by said outlet opening and said first opening and, hence, the rate at which fuel is delivered by said injector.

2. The fuel injector as claimed in claim 1, wherein said adjustable sleeve member is also provided with a second opening having a second outlet end.

3. A fuel injector comprising a valve needle which is slidable within a blind bore provided in a body and which is engageable with a seating to control the supply of fuel to an injector outlet opening having an inlet end to which fuel is delivered and an outlet end from which fuel is delivered, an adjustable sleeve member which is arranged within the blind bore, the sleeve member including a first opening having a first outlet end which is directly cooperable with the inlet end of the injector outlet opening, a combination of the first opening and the injector outlet opening defining a restriction to fuel being delivered by said injector, said adjustable sleeve member being moveable to move said first opening thereof relative to said outlet opening to vary the restriction to fuel flow formed by said outlet opening and said first opening and, hence, the rate at which fuel is delivered by said injector, wherein said adjustable sleeve member is also provided with a second opening having a second outlet end, and wherein said adjustable sleeve member is moveable between a first position in which said first outlet end of said first opening directly communicates with said inlet end of said injector outlet opening, a combination of said first opening and said outlet opening together defining a first restriction to fuel flow, and a second position in which said second outlet end of said second opening directly communicates with said inlet end of said injector outlet opening, a combination of said second opening and said injector outlet opening together defining a second restriction to fuel flow.

4. The fuel injector as claimed in claim 3, wherein said first and second openings are of substantially equal diameter, said first and second openings having entry ends of different shape to modify the restriction to fuel flow.

5. The fuel injector as claimed in claim 4, wherein said entry end of one of said openings is sharp and said entry end of the other of said openings is radiused.

6. The fuel injector as claimed in claim 3, wherein said second opening takes the form of a drilling of stepped form.

7. A fuel injector comprising a valve needle which is slidable within a blind bore provided in a body and which is engageable with a seating to control the supply of fuel to an injector outlet opening having an inlet end to which fuel is delivered and an outlet end from which fuel is delivered, an adjustable sleeve member which is arranged within the blind bore, the sleeve member including a first opening having a first outlet end which is directly cooperable with the inlet end of the injector outlet opening, a combination of the first opening and the injector outlet opening defining a restriction to fuel being delivered by said injector, said adjustable sleeve member being moveable to move said first opening thereof relative to said outlet opening to vary the restriction to fuel flow formed by said outlet opening and said first opening and, hence, the rate at which fuel is delivered by said injector, wherein said adjustable sleeve member is also provided with a second opening having a second outlet end, wherein said adjustable sleeve member is moveable between a first position in which said first outlet end of said first opening directly communicates with said inlet end of said injector outlet opening, a combination of said first opening and said outlet opening together defining a first restriction to fuel flow, and a second position in which said second outlet end of said second opening directly communicates with said inlet end of said injector outlet opening, a combination of said second opening and said injector outlet opening together defining a second restriction to fuel flow, and wherein said adjustable sleeve member is angularly moveable between said first and second positions.

8. The fuel injector as claimed in claim 7, wherein said adjustable sleeve member is provided with a plurality of teeth which cooperate with corresponding teeth associated with a drive shaft to effect angular movement of said adjustment member.

9. The fuel injector as claimed in claim 3, wherein said adjustable sleeve member is axially moveable between said first and second positions.

10. The fuel injector as claimed in claim 1, wherein said adjustable sleeve member is moveable relative to said injector outlet opening to vary the separation of said opening of said adjustable sleeve member from said injector outlet opening whilst maintaining communication therebetween to permit fuel delivery over a continuous range of fuel flow rates.

11. The fuel injector as claimed in claim 1, wherein said seating for said valve needle is defined by part of said adjustable sleeve member.

* * * * *